US010624450B2

(12) United States Patent
Cannon

(10) Patent No.: US 10,624,450 B2
(45) Date of Patent: Apr. 21, 2020

(54) ULTIMATE RINSE CUP BRUSH CLEANING SYSTEM

(71) Applicant: Dawson Cannon, San Francisco, CA (US)

(72) Inventor: Dawson Cannon, San Francisco, CA (US)

( * ) Notice: Subject to any disclaimer, the term of this patent is extended or adjusted under 35 U.S.C. 154(b) by 0 days.

(21) Appl. No.: 15/897,132

(22) Filed: Feb. 14, 2018

(65) Prior Publication Data

US 2018/0249818 A1 Sep. 6, 2018

Related U.S. Application Data

(63) Continuation-in-part of application No. 15/499,827, filed on Apr. 27, 2017, now Pat. No. 10,271,637.

(60) Provisional application No. 62/466,927, filed on Mar. 3, 2017.

(51) Int. Cl.

| | |
|---|---|
| ***A46B 17/06*** | (2006.01) |
| ***B44D 3/00*** | (2006.01) |
| ***B44D 3/12*** | (2006.01) |

(52) U.S. Cl.

CPC ..... *A46B 17/06* (2013.01); *B44D 3/006* (2013.01); *B44D 3/123* (2013.01); *A46B 2200/205* (2013.01)

(58) Field of Classification Search

CPC ..... A46B 17/06; B44D 3/006; B44D 3/123

See application file for complete search history.

(56) References Cited

U.S. PATENT DOCUMENTS

| | | | | |
|---|---|---|---|---|
| 9,527,338 | B1 * | 12/2016 | Kalb | B65D 25/20 |
| 2009/0269123 | A1 * | 10/2009 | Walker | B05C 17/0245 401/208 |
| 2010/0230413 | A1 * | 9/2010 | Crudgington, Jr. | B44D 3/128 220/495.02 |

* cited by examiner

*Primary Examiner* — Shay Karls

(74) *Attorney, Agent, or Firm* — KSIP; Kelsey Stout

(57) ABSTRACT

A set of molded silicone rubber devices is used for cleaning a variety of paint brushes in a variety of containers. A circular basic paint "puck" is molded silicone rubber with paint-cleaning teeth and a diameter matching the bottom of a standard coffee cup or else a standard disposable paint mixing cup of 8 oz, 16 oz, 32 oz or 64 oz. A bucket puck has a diameter fitting a 1-gallon or 5-gallon paint bucket and is suitable for large, heavy brushes. An expansible paint puck doubles in size when submerged in turpenoid paint solvent and has a silicone rubber purity and hardness ensuring uniform expansion and contraction. A paint puck set includes solvent container, stable footing and ultimate rinse cup topper with brush holders, flexible cup grip, brush scraping surfaces and drip tray.

20 Claims, 15 Drawing Sheets

ULTIMATE RINSE CUP BRUSH CLEANING SYSTEM

CLAIM OF PRIORITY BENEFIT

This application claims the benefit of USPTO Utility application Ser. No. 15/499,827, filed 27 Apr. 2017, which Utility Application claims benefit of Provisional Application No. 62/466,927, filed 3 Mar. 2017.

FIELD OF THE INVENTION

The invention relates a system used for cleaning a variety of paint brushes in a variety of containers.

BACKGROUND INFORMATION

Artists and detail painters use containers of water or other solvents to wash the paint from their brushes when switching paint colors. Containers typically chosen for this purpose include standard-sized coffee cups and disposable paint mixing cups in 8 oz, 16 oz, 32 oz and 64 oz sizes.

Painters will have trouble attempting to wash and scrape paint from brush bristles and brush stems using the smooth inner surfaces of the cups. The invention provides a system of devices featuring specialized solvent containers, specialized brush holders and drip trays, and specialized brush cleaning surfaces applicable to a range of solvents and solvent container sizes. The invention is stable in various solvents, inexpensive and easy to clean.

Paint Puck Specifications

A basic paint "puck" is circular and molded of silicone or rubber with a diameter matching the bottom of a standard coffee cup or else a standard disposable paint mixing cup of 8 oz, 16 oz, 32 oz or 64 oz. These basic paint pucks are distinguished from bucket pucks, proportioned and stiffened for larger paint buckets, and expansible pucks, which reach full use diameter in turpenoid solvents. To distinguish between expanded and unexpanded diameters possible in certain expansible paint pucks, diameter may also be expressed as rest diameter.

The puck is a disk featuring cleaning surfaces on the top side and, on the bottom, suction cups for securing the puck to the bottom of the cup and preventing its moving during brush cleaning. A painter using the puck attaches it to the bottom of the brush-washing cup, fills the cup with water, and agitates paint brushes against the cleaning surfaces to clean them. The shapes of these disk and cleaning surface portions in a basic paint puck, or in an expansible paint puck prior to expansion, may also be referred to as rest shape.

Paint puck material must be an elastomer that allows molding of specialized cleaning surfaces, easy cleaning and easy removal from the cup. The elastomer must have enough rigidity to provide a functional suction cup and for its cleaning surfaces to provide resistance to sticky, wet brush bristles covered in paint. Thus, the paint puck material must have a minimum Shore(A) hardness of 15 and a maximum Shore(A) hardness of 70. Lower hardnesses may require an externally attached suction cup, so a minimum Shore(A) hardness of 25 is preferred when using a single-piece mold including a suction cup and for at least "good" durability. Higher hardnesses are good for brush cleaning surfaces, but may cause difficulty in removal from the bottom of a cup full of paint and water, so a maximum Shore(A) hardness of 55 is indicated in the preferred embodiment. The preferred embodiment is made of flexible silicone rubber to allow economy of manufacturing, chemical resistance and the rigidity and flexibility qualities listed above and throughout this disclosure.

When manufactured with an integral suction cup, the paint puck uses at least four molds. When manufactured with a separated, attachable suction cup, the paint puck can be made with only two molds. The suction cup sits as flush as possible to the bottom of the middle disk of the paint puck, adding no more than 7 mm to its height, in order to leave room inside the washing cup.

Paint Cleaning Teeth

The cleaning surfaces on the upper surface of the paint puck are arranged as three concentric sets of "teeth" arranged to provide brush cleaning surfaces when the brush is agitated in either radial or circular motion. Each concentric ring of teeth is stepped in height so that the two inner rings of teeth present outside surfaces standing higher than the previous, more outside ring of teeth. Radial motion toward the center of the puck scrapes the brush against the outside of each ring.

Within each of the three rings, the teeth are varied in height and stand separate, so that circular motion of a brush in the cleaning cup scrapes the brush bristles against the edges and points of the teeth.

The innermost ring of teeth comprises a central "beak", which is the tallest and most massive tooth. The mass of the beak provides enough rigidity to divide, scrape and clean large paintbrushes with heavy bristles. The largest tooth is placed in the center of the paint puck so that a large brush placed into the washing cup without care will strike the beak.

To prevent a paintbrush placed in the washing cup from tipping over when rested on the beak, the beak should be no taller than 50 mm. To clean a large brush, the beak should be no shorter than 20 mm. In the preferred embodiment, the beak height can be set at between 20% to 30% of the washing cup depth. The next ring of teeth can be set at ⅔ the height of the beak, and the outer ring of teeth at ⅓ the height of the beak, with the smaller teeth at least 7 mm tall.

The middle disk of the paint puck to which the teeth and suction cup attach is at least 5 mm thick. To prevent the paint puck folding back on itself in the water of the washing cup during agitation and washing, the middle disk plus smallest teeth must, when the disk is doubled back on itself, have a total thickness equal to at least ⅙ the diameter of the paint puck.

Convertible Brush Cleaning System Specifications

Components of the convertible brush-cleaning system shown include a container topper, a container portion, a container foot and a paint puck. A gripping lip portion of the container topper in a preferred embodiment will have a diameter approximately the same as or slightly smaller than the upper diameter of a solvent container it is meant to be used with.

Thus, container toppers with gripping lip diameters matched to an 8 oz, 16 oz, 32 oz or 64 oz solvent container will be specified embodiments. Other specified embodiments will have container toppers with gripping lip diameters matched to a 1 gallon or 5 gallon paint bucket, ones matched to other standard solvent container sizes and ones matched to a particular solvent container included in the brush cleaning system with the container topper.

The gripping lip must have a minimum Shore(A) hardness of 15 and a maximum Shore(A) hardness of 70 in the preferred embodiment. In some embodiments, the gripping lip portions have lower hardnesses than the remaining upper portion of the container topper, so a minimum Shore(A) hardness of 25 is preferred for the remaining upper portion of the container topper. Higher hardnesses are good for brush cleaning surfaces and brush holding clips, but may cause difficulty in removal for the gripping lip, so a maximum Shore(A) hardness of 55 is indicated for the gripping lip in the preferred embodiment.

To enable stretching over most standard-size drinking cups such as coffee cups, the most common size of the container topper gripping lip will be equal to or greater than 45 mm in diameter. For all sizes of container topper, the remaining upper portion of the container topper will have a diameter equal to or greater than the gripping lip and greater than the interior top diameter of the solvent container for which it is meant, whether that solvent container is a standard 8 oz, 16 oz, 32 oz or 64 oz disposable cup, respectively, or a paint bucket or included container.

Other methods and structures are described in the detailed description below. This summary does not purport to define the invention. The invention is defined by the claims.

DETAILED DESCRIPTION

Figure 1:
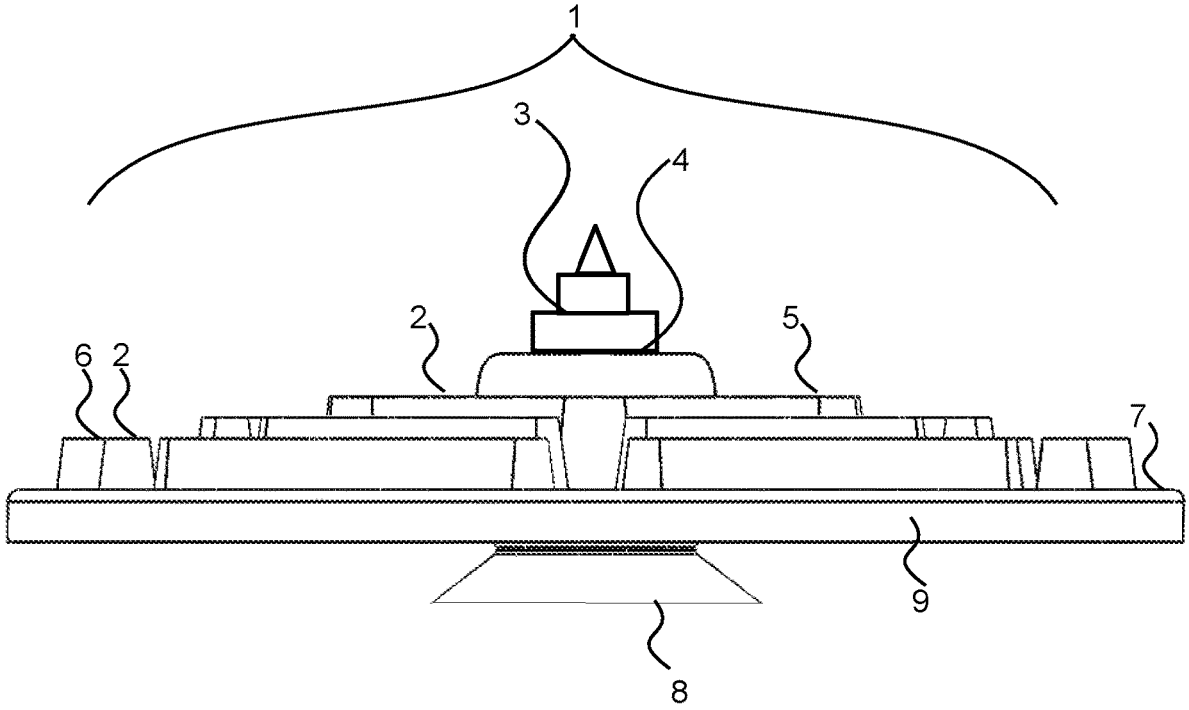
FIG. 1 is a perspective view of an embodiment of the paint puck featuring spike-shaped teeth. The beak, $2^{nd}$ ring of teeth and $3^{rd}$ ring of teeth are shown affixed to the top of the disk. The suction cup is affixed to the bottom of the disk.

FIG. 1 is a side view of an embodiment of the paint puck 1 featuring teeth 2 and a spike-shaped beak 3. Paint puck material must allow a Shore(A) hardness of between 15 and 70 and must allow enough flexibility to remove a wet, slippery paint puck from within a washing cup into which it may be tightly fitted. Paint puck material is, preferably, chemically inert or resistant to painting materials and cleansers. Paint puck material is also relatively inexpensive to use in injection molding. Therefore, paint puck material is, in the preferred embodiment, silicone rubber, but may be any rubber, plastic or elastomere which meets these requirements.

The first set 4 of teeth including a beak 3, second plurality 5 of teeth and third plurality 6 of teeth are shown affixed to the top of the staging disk 7. The suction cup 8 is affixed to the bottom of the staging disk. A staging disk outside edge 9 shows the thickness of the staging disk.

Teeth are, for the purposes of this application, portions of paint puck material protruded upward from the upper surface of the staging disk and having vertical surfaces against which paint brush bristles may be brushed in order to scrape paint from the bristles or disperse the paint into a solvent. The beak 3 is considered a type of tooth here. Teeth may take the shape of, for example, rectangular towers, cylindrical towers, spikes, a series of connected or detached walls, concentric circles, or fanciful shapes.

Figure 2:
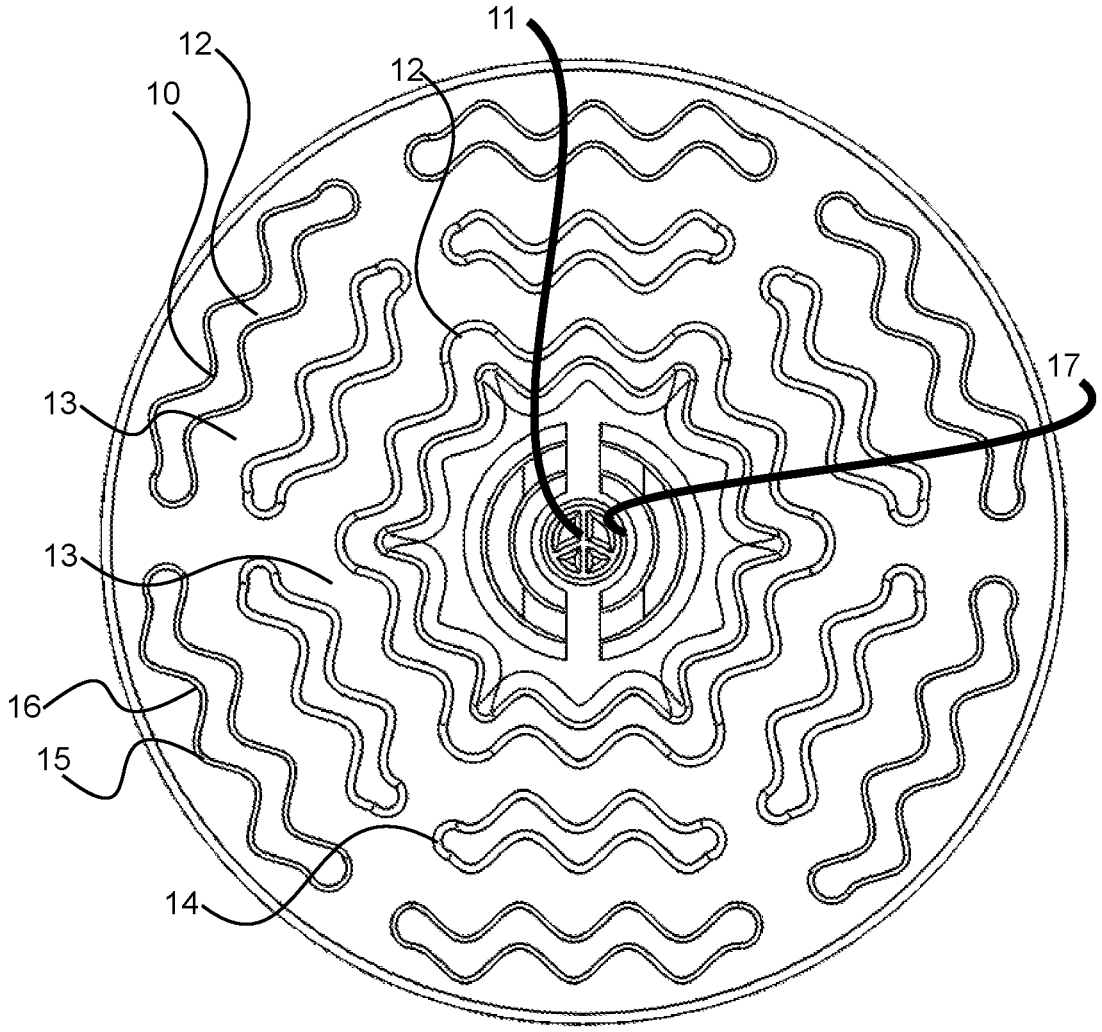
FIG. 2 is a side view of an embodiment of the paint puck featuring ledge-shaped teeth and a spike-shaped beak. The beak, $2^{nd}$ ring of teeth and $3^{rd}$ ring of teeth are shown affixed to the top of the disk. The suction cup is affixed to the bottom of the disk.

FIG. 2 is a top view of the paint puck of FIG. 1 featuring ledge-shaped 10 teeth and a spike-shaped beak 11. The beak, in this example comprising the entirety of the first set 4 of teeth, second set 5 of teeth and third set 6 of teeth are shown affixed to the top of the staging disk 7. In the preferred embodiment, the first, second and third set of teeth are arranged concentrically as shown here.

The ledge-shaped teeth and the spaces between them are considered lands 12 and grooves 13 making up a lands-and-grooves pattern of teeth as shown here. An indicated tooth end 14 and tooth outside corner 15 are examples of circular paint-cleaning barriers. Circular paint-cleaning barriers are vertical edges of teeth against which paintbrush bristles scrape when a paintbrush is brushed in a circular motion across the upper surface of the paint puck.

An indicated tooth inside corner 16 and beak edge 17 are examples of radial paint-cleaning barriers. Radial paint-cleaning barriers are vertical edges of teeth against which paintbrush bristles scrape when a paintbrush is brushed in a radial motion across the upper surface of the paint puck, from center to edge or from edge to center.

Figure 3:
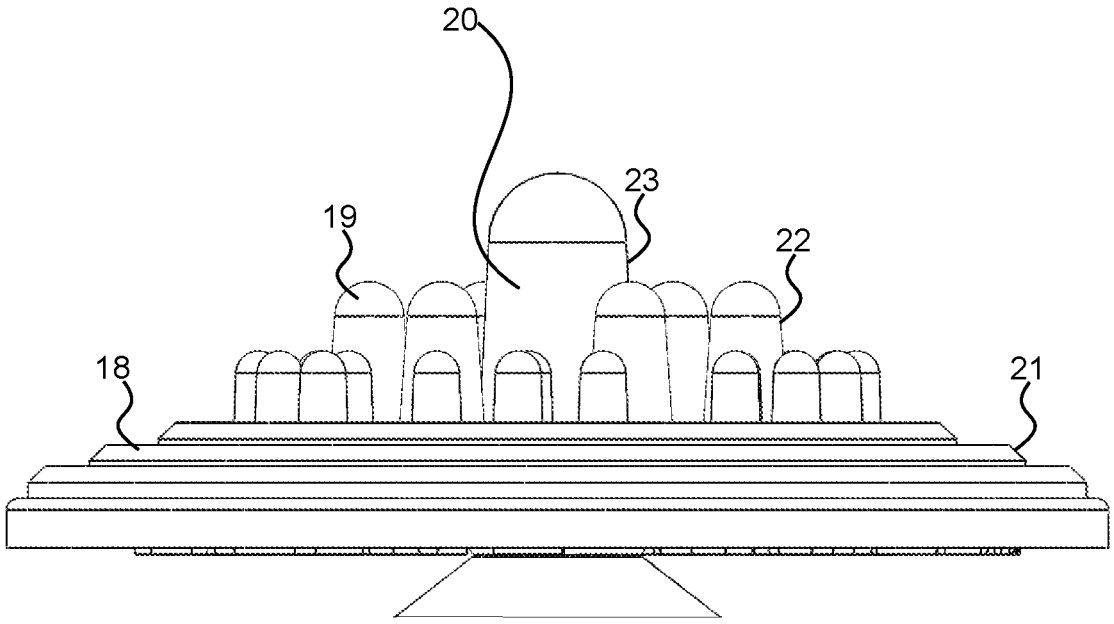
FIG. 3 is a top view of an embodiment of the paint puck featuring ledge-shaped teeth and a spike-shaped beak. The beak, $2^{nd}$ ring of teeth and $3^{rd}$ ring of teeth are shown affixed to the top of the disk.

FIG. 3 is a side view of an embodiment of the paint puck featuring concentric circular teeth 18 cylindrical teeth 19 and a cylindrical beak 20. The first set 4 of teeth, second set 5 of teeth and third set 6 of teeth are shown affixed to the top of the staging disk. The suction cup 8 is affixed to the bottom of the disk.

A vertical edge of a concentric circular tooth 21, a vertical edge of a cylindrical tooth 22 and a vertical edge of a beak 23 indicated are examples of radial paint-cleaning barriers. While the teeth making the radial paint-cleaning barriers can have Shore(A) durometer of as low as 15, it is preferred that the teeth provide a stronger resistance to heavy, wet, paint-coated bristles in the preferred embodiment of the paint puck. Teeth that provide a stiffer radial paint-cleaning barrier by having a Shore(A) durometer of at least 25 are referred to, for the purposes of this application, as having an aggressive radial barrier commitment.

The side view here also allows us to introduce another key feature of paint puck that will be discussed further in FIG. 6. It will be seen that the paint puck must be constituted such that it will not fold over on itself during use. This resistance to remaining at rest such that the staging disk is folded is referred to for the purposes of this application as a plane reversion commitment. The plane reversion commitment may also be thought of as a tendency for the staging disk to return to a flat plane shape after being flexed or folded. A paint puck device of between 15 and 70 Shore(A) durometer will have plane reversion commitment by having a staging disk thickness and height of shortest tooth that, added together, are larger the one-twelfth the diameter of the staging disk.

Figure 4:
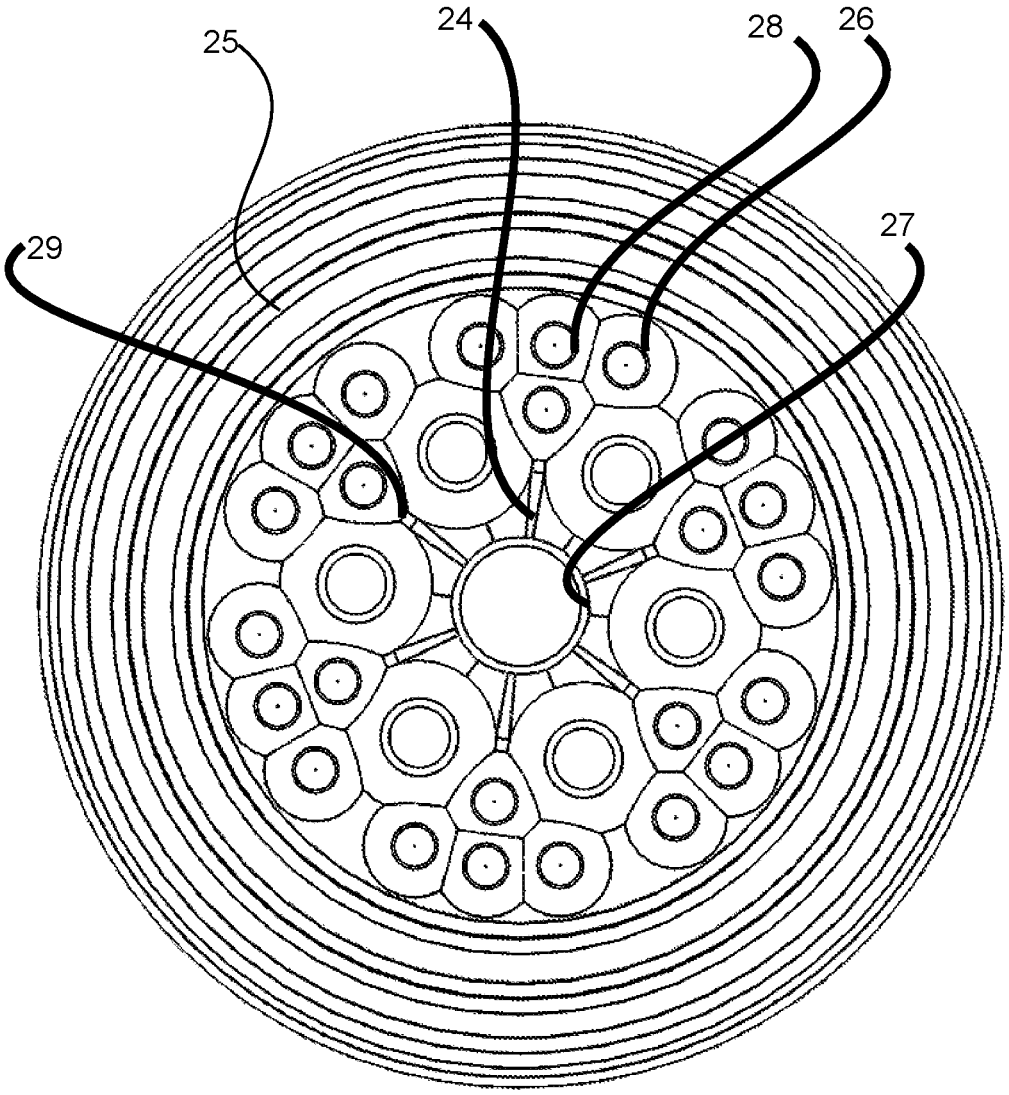
FIG. 4 is a top view of an embodiment of the paint puck featuring concentric sets of teeth.

FIG. 4 is a top view of an embodiment of the paint puck featuring concentric circular third set of teeth 18, cylindrical second concentric set of teeth 19 and a first central set of teeth featuring cylindrical beak 20 and ledge-shaped teeth 24 radiating outward from the beak.

The concentric circular third set of teeth 18 describe a lands-and-grooves tooth pattern and act as radial paint-cleaning barriers 25. The outside vertical edge of a cylindrical tooth 26 and vertical edge of the beak 27 also provide radial paint-cleaning barriers.

The lateral vertical edge of a cylindrical tooth 28 and a vertical edge of a ledge-shaped tooth 29 provide circular paint-cleaning barriers.

The thin, free-standing vertical teeth of the second set of teeth 19 describe a spiky teeth pattern, whether the tooth shapes are spiky, cylindrical or rectangular.

Figure 5:
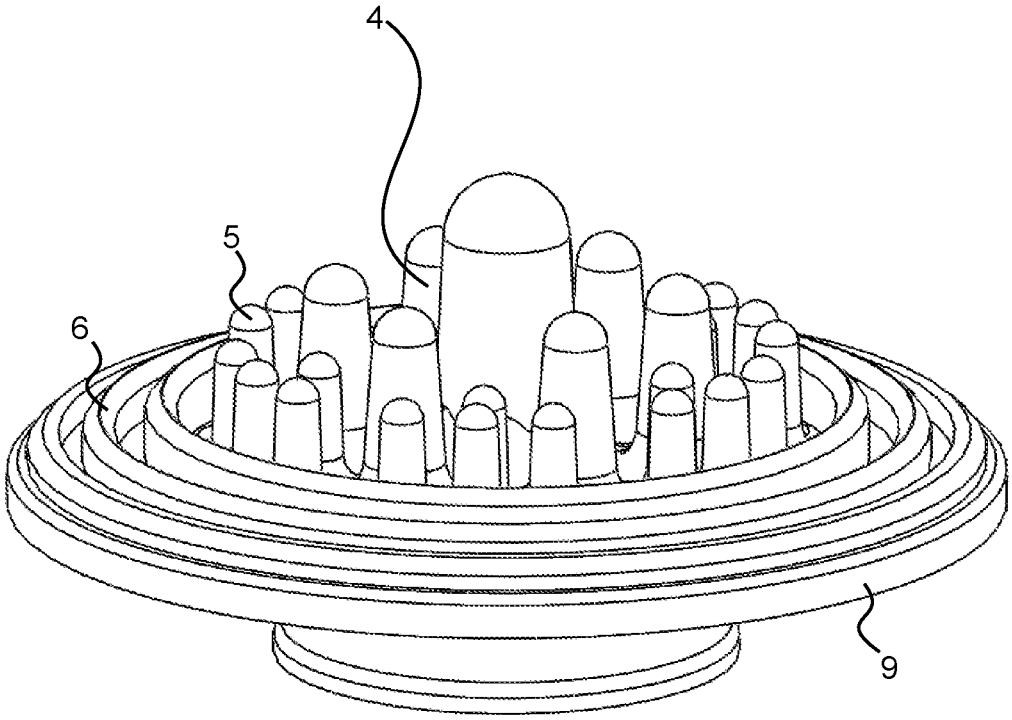
FIG. 5 is a perspective view of the paint puck of FIG. 3 and FIG. 4.

FIG. 5 is a perspective view of the paint puck of FIG. 3 and FIG. 4. The first set 4 of teeth, second set 5 of teeth and third set 6 of teeth are shown affixed to the top of the staging disk. The suction cup 8 is affixed to the bottom of the disk.

The staging disk edge 9 indicated will show that the staging disk is, to contribute to the plane reversion commitment, at least 5 mm thick in the preferred embodiment. The minimum tooth-height for the beak 3 is at least 8 mm in order that the beak will scrape paint from long brush bristles. Also, to provide useful paint-scraping surfaces, the maximum tooth-height for the teeth in the third, outer set of teeth is 5 mm less than the minimum tooth-height for the teeth in the second set of teeth in the preferred embodiment. Similarly, the maximum tooth-height for the teeth in the second set of teeth is 5 mm less than the minimum tooth-height for the first set of teeth in the preferred embodiment.

Figure 6:
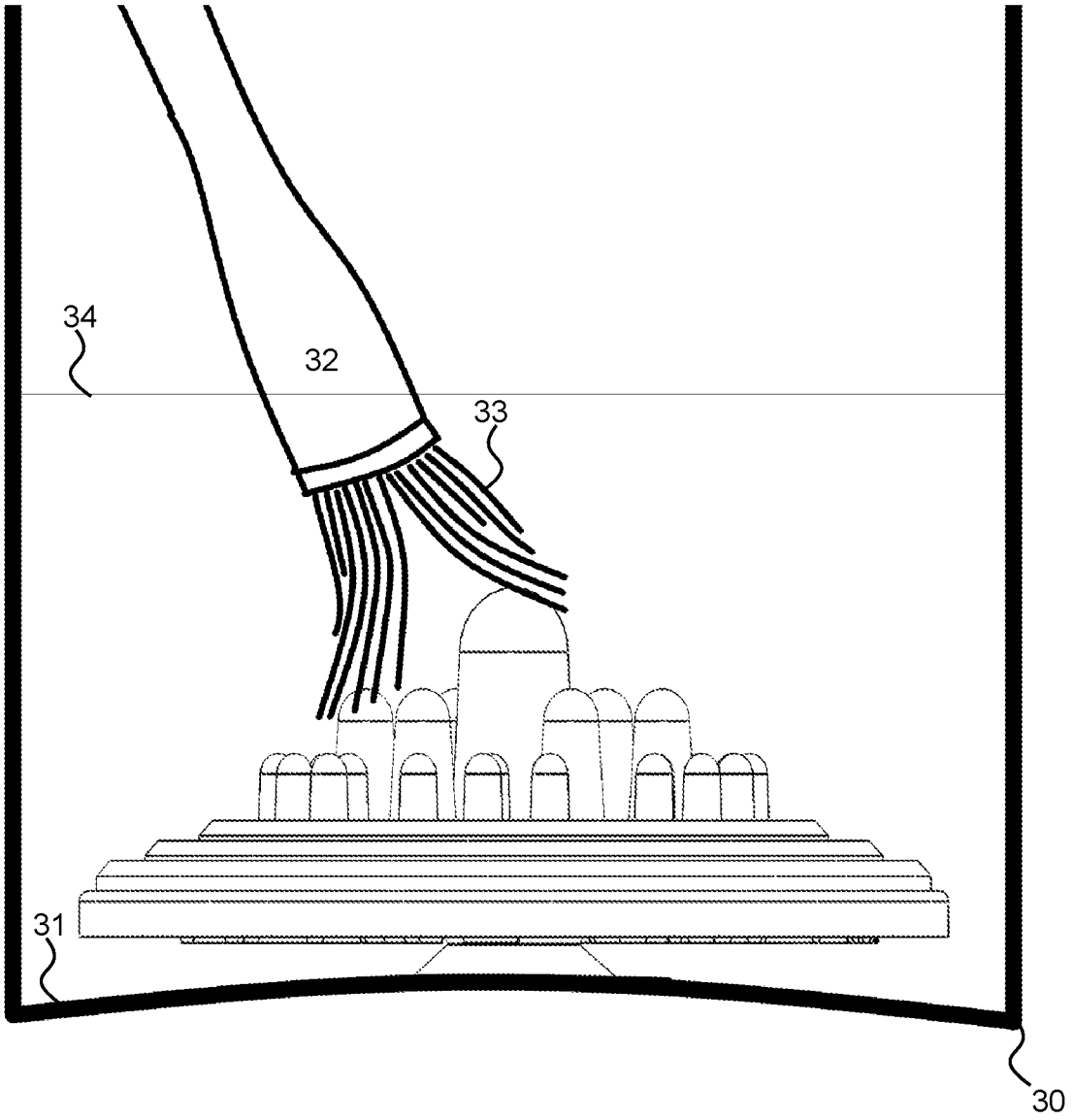
FIG. 6 is a view of a paint puck in use.

FIG. 6 is a view of a paint puck in use. The paint puck is fitted into a coffee cup 30 with its suction cup fitted to the bottom surface 31 of the cup. To enable fitting into and nearly filling most standard-size drinking cups such as coffee cups, the most common size of the paint puck will be less than or equal to 55 mm in diameter. For all sizes of paint puck, the paint puck will have a diameter of at least 90% the interior bottom diameter but less than 100% the interior bottom diameter of the paint washing cup for which it is meant, whether that paint washing vessel is a standard 8 oz, 16 oz, 32 oz or 64 oz disposable cup, respectively.

Because the paint puck will be nearly flush to the interior diameter of the cup in some instances, the paint puck material must be flexible enough to allow bending for removal from a cup. A paint puck that is flexible enough for removal from a cup into which it is fitted tightly will be referred to as having an enhanced paint puck removal commitment for the purposes of this application. In practical terms, a paint puck staging disk having a Shore(A) hardness of 55 or less is flexible enough to have an enhanced paint puck removal commitment.

To prevent extraneous wobbling and flexing of the paint puck by the user's paint brush, the suction cup 8 height must be limited. In the preferred embodiment, the suction cup has a height of no more than 15 mm unflexed.

A paint brush 32 with bristles 33 is shown to help illustrate use of the paint puck. A user fits a paint puck device into a paint washing cup and secures it to the interior bottom surface of the paint washing cup using the suction cup. The user will general fill the paint washing cup with a solvent liquid such as water or turpentine to a depth such that the surface of the solvent 34 is submerging the top of the paint puck or at least 20 mm.

Grasping a paintbrush having a handle and bristles by its handle, the bristles having been coated with paint in the act of painting, the user places the paintbrush into the paint cup such that its bristles enter the solvent liquid and touch the paint puck device. As the diagram illustrates, agitating the paintbrush in radial or circular motions scrapes and splits the mass of bristles against the paint puck teeth, removing and dispersing paint into the solvent.

As mentioned above, the paint puck must be constituted with plane reversion commitment such that it will not fold over on itself during use. FIG. 6 illustrates the importance of plane reversion commitment. If a paint brushes slides under the edge of a paint puck—possible given the raising of the paint puck by the suction cup and the variations of paint washing cup sizes—and lifts a staging disk edge, an improperly constituted device without plane reversion commitment could fold over and present its smooth bottom surface. The user would not see the folding occur through turbid solvent, and the smooth bottom surface would not work to scrape paint. The danger of disk folding is also increased because the disk of the paint puck is buoyed by solvent. Thus, inadvertent disk folding must be prevented by balancing staging disk thickness, tooth heights and paint puck material flexibility against the diameter of the staging disk such that the paint puck device exhibits plane reversion commitment.

After removing the paintbrush from the paint washing cup or otherwise finishing painting activities, the user of the paint puck disposes of his used solvent and removes the paint puck device from the paint washing cup. As mentioned above, the paint puck may be slippery with paint and solvent. To be amenable to removal from a tight fit, the paint puck must be pinchable or compressible and exhibit at least some basic puck removal commitment wherein the paint puck material durometer is Shore(A) 70 or less. Preferably, an enhanced paint puck removal commitment is exhibited via paint puck material durometer of Shore(A) 55 or less. The paint puck can then be cleaned using soap, water or solvents.

Figure 7:
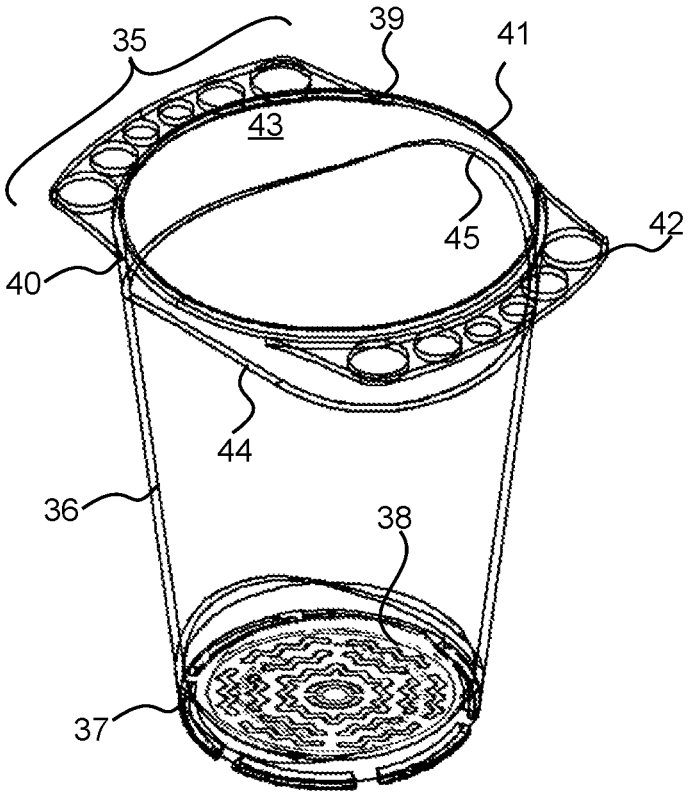
FIG. 7 shows a perspective view of a convertible brush-cleaning system for multiple cup sizes.

FIG. 7 shows a perspective view of a convertible brush-cleaning system for multiple cup sizes. Components of the convertible brush-cleaning system shown include a container topper 35, a container portion 36, a container footing 37 and a paint puck 38. The container portion is often transparent or translucent plastic, especially when provided as a portion of the brush-cleaning system, and is typically illustrated as transparent here.

The container topper 35 is made of either a hard plastic or an elastomeric material such as silicone rubber. As indicated, the container topper 35 has a disc-like shape with an upper surface 39, a lower surface (obscured here) 40 and a rim 41. Some or all of the rim is ringed with brush holder portions 42.

Extending from the lower surface of the disc-like portion is a gripping lip 43. The gripping lip has a circular, downward facing opening 44 with a diameter chosen to match the diameter of a container opening, or have a diameter slightly smaller. The gripping lip 43 is flexible such that it can be stretched over the upper opening of a given cup, bucket or other container having the same or slightly larger opening.

In the preferred embodiment, the gripping lip rim has a non-uniform, non-circular edge 45 such that some portions of the gripping lip rim 45 are longer and extend further down the outside surface of the container 36 than do other portions of the gripping lip rim. In the illustrated example, this non-uniform rim shape is a sine-wave-like curve. However, other non-uniform rim shapes are possible, such as a round opening with tab-like extrusions. The non-uniform rim shape allows for portions of the rim to be used for gripping the rim when stretching it over containers, or removing it.

Figure 8:
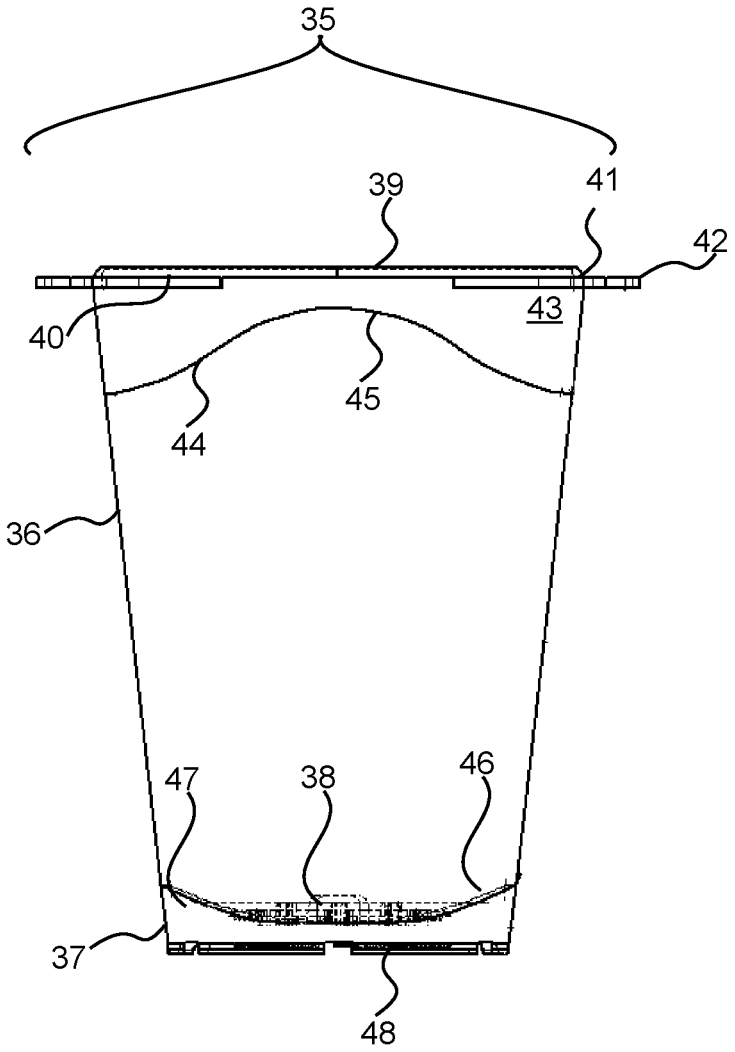
FIG. 8 shows a side view of a convertible brush-cleaning system for multiple cup sizes.

FIG. 8 shows a side view of a convertible brush-cleaning system for multiple cup sizes. Indicated are a side view of a brush holder portion 42 of the container topper 35, side view of a gripping lip 43, side view of a paint solvent container 36, side view of a container foot 37 and a side view of a paint puck 38.

The brush holder portion 42 of the container topper 35 extends horizontally from the circular rim 41 of the container topper. Brush holders can ring the container topper rim continuously, or can be punctuated around the rim, as in this illustration.

In this example, the gripping lip 43 is built for a specific size and shape of solvent cup or container 36. Because the gripping lip diameter is meant for a known cup diameter, it can be made of a hard plastic or hard silicone and need not have any more radial flexibility than is required to slide the topper on or off of the cup. A peak and two troughs of the sine-wave-shaped rim 45 are indicated, allowing easier maneuvering of a tightly fitted topper onto a cup. The topper can be in a variety of colors for aesthetic or sales purposes.

In some embodiments of the invention, the topper 35, and particular the gripping lip 43, is meant to be flexible enough to fit over a variety of different cups. Here, in the pictured embodiment of FIG. 8, the solvent cup 35 is provided as part of the brush cleaning system. The solvent container mouth outer diameter and the solvent container topper's gripping lip inner diameter are size matched in this embodiment of the brush cleaning system The solvent cup can be a straight cylinder, or it can be cylinder narrowing from top to bottom as pictured. The solvent container 35 can be clear or in a variety of colors for aesthetic or sales purposes.

The bottom 46 of the solvent container fits into the footing 37. Here again, the solvent container base outer diameter and the container foot inner diameter are size matched in this embodiment of the brush cleaning system. Therefore, the upper lip 47 of the container footing can be a hard plastic or silicone fitted to the solvent container's outside lower diameter.

The heel portion 48 of the footing 37 is meant to help prevent the solvent container 36 from tipping over. To this end, it is made of an elastomeric material like silicone. In the embodiment shown, where the container footing upper lip 47 is hard and matched to a specific solvent container lower diameter, the heel portion 48 is softer and more elastic than the footing upper lip. In the preferred embodiment, the heel portion of the footing has a lower Shore(A) hardness than the portions of the container foot above it.

The heel portion 48 is also thicker vertically than the thickness of the included solvent container bottom, and it is thicker than the transverse thickness of the container foot upper lip. The heel portion has a lug or notched shape on its bottom side for friction, grip and flexibility. The heel portion is at least as great in diameter as, or greater than, the footing upper lip and the provided solvent container bottom diameter. Finally, in the preferred embodiment, the footing heel is greater in weight than the topper, and it is greater in weight than the included solvent container. These features of the footing heel are anti-spill features, and are meant to prevent tipping, sliding or bouncing of the solvent container.

A paint puck 38, shown side view, fits inside the bottom of the matched, included solvent cup 36. Thus, the topper 35, container 36, footing 37 and paint puck 38 are separable portions in the preferred embodiment. However, in other embodiments of the invention, the paint puck is of one body with the footing, with a circular slot between the outer rim of the paint puck and the inner rim of the upper lip. In such an embodiment, the solvent cup has an open bottom that fits into said circular slot.

Figure 9:
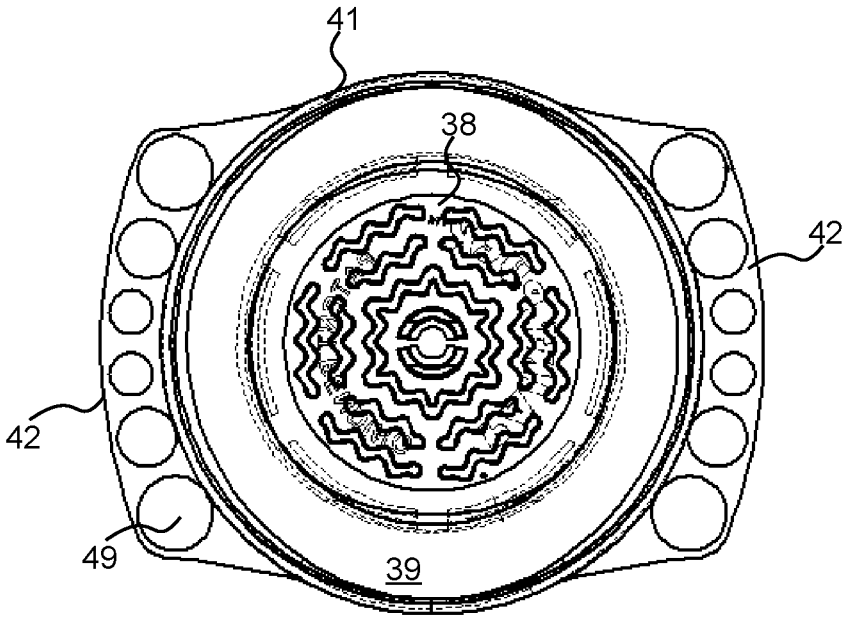
FIG. 9 shows a top view of a convertible brush-cleaning system for multiple cup sizes.

FIG. 9 shows a top view of a convertible brush-cleaning system for multiple cup sizes. Looking downward, we are shown the paint puck 38, upper surface 39 of the topper, topper rim 41, and two brush holder portions of the topper 42. Each brush holder portion has openings 49 or holes of different sizes for holding paint brushes.

Figure 10:
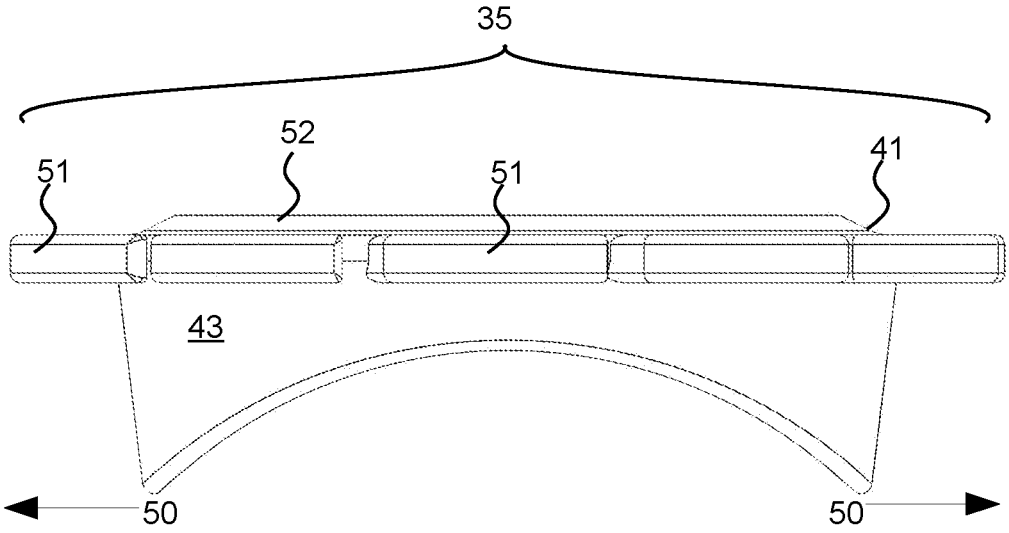
FIG. 10 shows a close-up side view of another embodiment of a topper portion of a convertible brush-cleaning system.

FIG. 10 shows a close-up side view of another embodiment of a topper portion 35 of a convertible brush-cleaning system.

In this embodiment, the topper 35 is not matched exactly to a specific solvent cup, but rather is built to be used with a variety of unspecified containers with upper opening diameters roughly matching the diameter of the topper gripping lip. In this embodiment, the topper gripping lip 43 is made of a soft elastomer bestowing stretch capacity in the radial direction 50 to the gripping lip.

Thus, in the is embodiment of the invention, the brush cleaning topper has the capacity for the gripping lip to be fitted around a solvent container with an opening greater in diameter than the diameter of the gripping lip, or even around a container opening that is not circular. The gripping lip having radial stretch capacity means it has a maximum stretch interior diameter when fully stretched, and a rest interior diameter when not stretched. In the preferred embodiment, a Shore(A) hardness of 60 or less is required for adequate radial stretch capacity.

Also shown in this embodiment are brush-holding clips 51 disposed around the rim 41 of the topper, rather than brush-holding holes in two portions as described above. Also indicated is a brush-cleaning vertical fin 52 extending upward from the upper surface of the topper.

Figure 11:
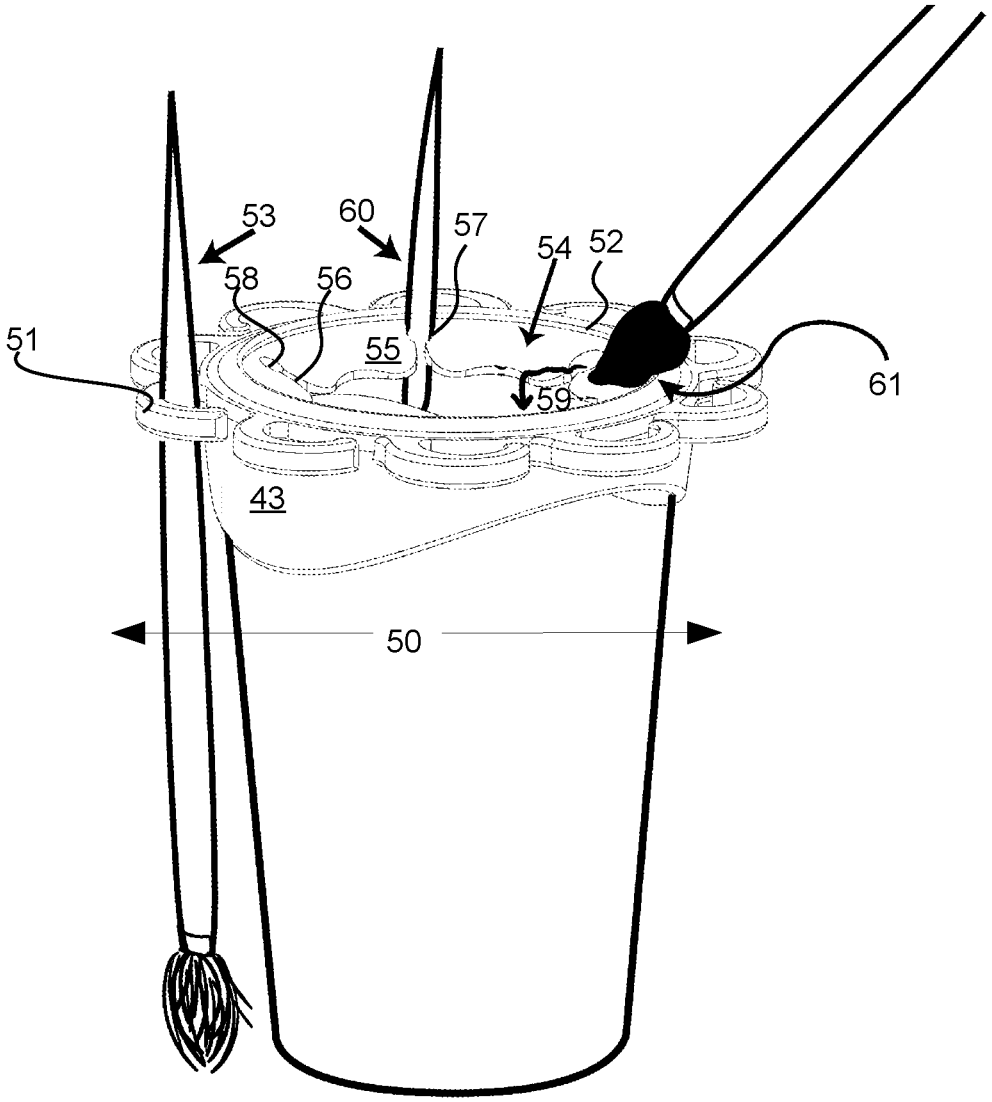
FIG. 11 is a perspective view of the topper of FIG. 10 in use with brushes.

FIG. 11 is a perspective view of the topper of FIG. 10 in use with brushes. A first brush clip 51 holds a first brush 53. An elastomeric gripping lip 43 has radial stretch 50 to fit various cup sizes. A brush-cleaning vertical rim 52 extends upward from the upper surface of the topper. A squeegeeing shelf 54 extends inward from the rim of the topper.

The squeegeeing shelf is, in this embodiment, of a harder material than the gripping lip. The squeegeeing shelf 54 comprises primary fins 55 for the squeegeeing of brushes upon brush pull. The squeegeeing shelf also comprises squeegeeing channels 56 that terminate in additional brush-holder squeegee slots of a first size 57 and a second size 58. Wet brushes may be cleaned by pulling them through the squeegee channels or through the brush-holder squeegee slots. The shelf is sloped downward to channel run-off 59 into the cup, and functions as splash or spill control.

A second brush 60 is shown stored in a brush-holder squeegee slot. A third brush 61 is shown being cleaned by being scraped against a primary fin and against the brush cleaning vertical rim.

Figure 12:
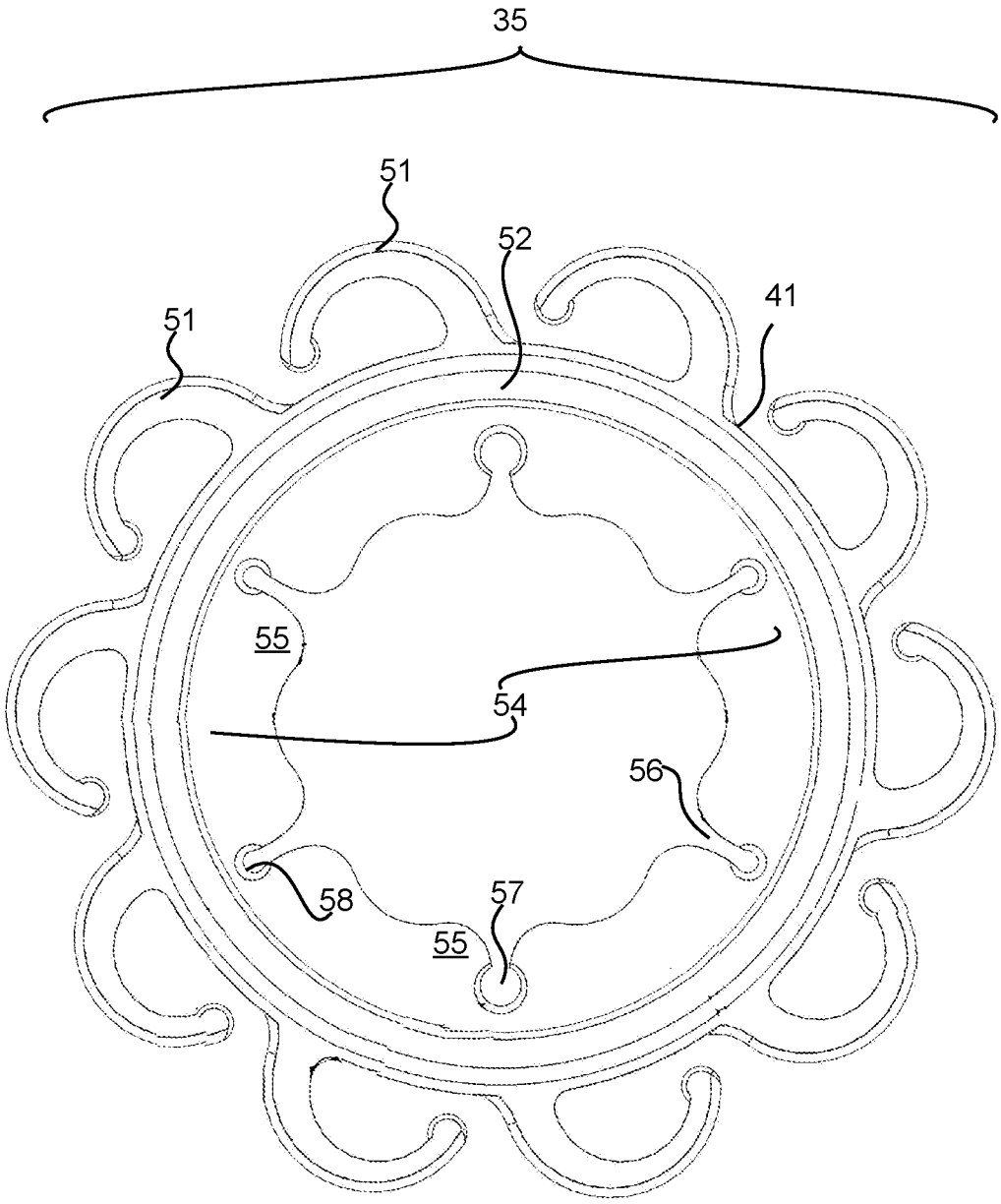
FIG. 12 is a top view of the topper of FIG. 10.

FIG. 12 is a top view of the topper of FIG. 10. Brush-holding clips 51 are disposed around the rim 41 of the topper 35. Also indicated is a brush-cleaning vertical rim 52 extending upward from the upper surface 39 of the topper. A squeegeeing shelf 54 comprises primary fins 55 for squeegeeing brushes upon brush pull. The squeegeeing shelf also comprises squeegeeing channels 56 that terminate in additional brush-holder squeegee slots of a first size 57 and a second size 58.

Figure 13A:
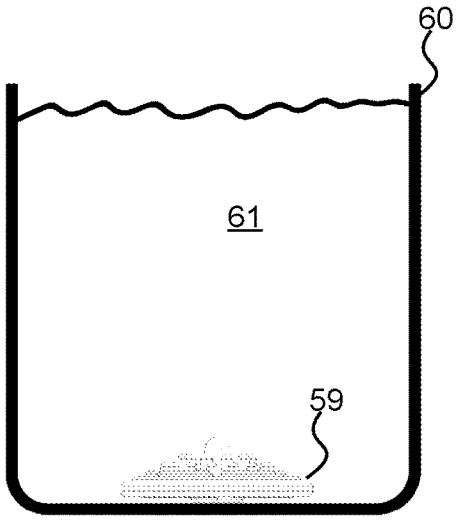
FIG. 13A and FIG. 13B are side views of an expansible paint puck constituent of the convertible brush-cleaning system that expands and shrinks in solvent.
Figure 13B:
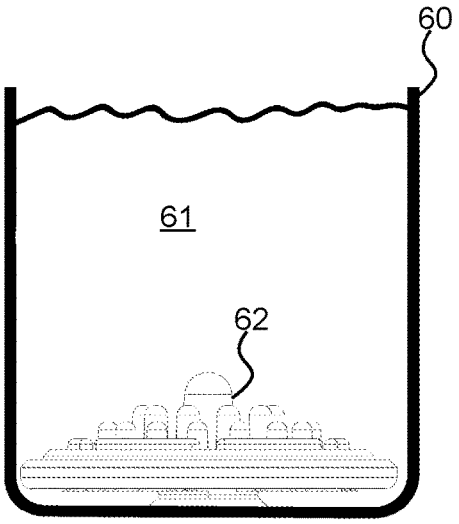

FIG. 13A and FIG. 13B are side views of a turpenoid-expansible paint puck constituent of the convertible brush-cleaning system that expands and shrinks in solvent. An unexpanded paint puck made of turpenoid-absorbing paint puck material 59 is shown in a jar 60 submerged in turpentine 61 or other turpenoid solvent at a first instance in FIG. 13A. Then, at second instance shown in FIG. 13B, the expansible paint puck in the same jar 60 of solvent 61 is illustrated in an expanded state 62.

Because silicone rubber in the indicated embodiment absorbs turpenoids by expanding to at least 180% of its initial diameter (200% in the preferred embodiment), the paint puck of this embodiment of the invention is manufactured at half, or slightly less than half, the diameter of the container it is meant to be used with. A painter who intends to use the illustrated paint puck with turpenoid solvent will be able to buy a paint puck with label, packaging or instructions indicating that the paint puck of the brush cleaning system is for use with turpenoids, that it will expand, the approximate size of the solvent-expanded diameter to which it will expand, and example containers it will fit when expanded. In some embodiments of the invention, a container matched to the expanded diameter of the turpenoid paint puck is included.

To enable fitting into and nearly filling most standard-size drinking cups after expanding in turpenoid solvent, the most common size of the paint puck will be less than or equal to 27 mm in diameter, expanding to between 45 mm and 65 mm in diameter. For all sizes of turpenoid-expanding paint puck, the diameter when expanded will be at least 90% the interior bottom diameter but less than 100% the interior bottom diameter of the paint washing cup for which it is meant, whether that paint washing vessel is a standard 8 oz, 16 oz, 32 oz or 64 oz disposable cup, respectively. Similarly, when the turpenoid-absorbent paint puck is provided paired with a solvent container as part of a brush-cleaning system, the unexpanded turpenoid-absorbent paint puck has a diameter of at least 45% but less than 50% the interior bottom diameter of the paired solvent container.

The purity and hardness of the silicone rubber affects the degree, rate and regularity of the paint puck expansion. A Shore(A) hardness lower than 35 or a silicone purity lower than 80% can cause the paint puck to expand in an irregular or non-circular way. Thus, the turpenoid-adapted paint puck material in the preferred embodiment of the turpenoid paint puck of the brush cleaning system uses molded silicone of a Shore(A) hardness greater than 45 and purity greater than 90%. This allows the expansible puck to expand uniformly and retain its rest shape when expanded. When removed from the turpenoid solvent, the turpenoid paint puck shrinks back to its original size, for reuse.

Figure 14:
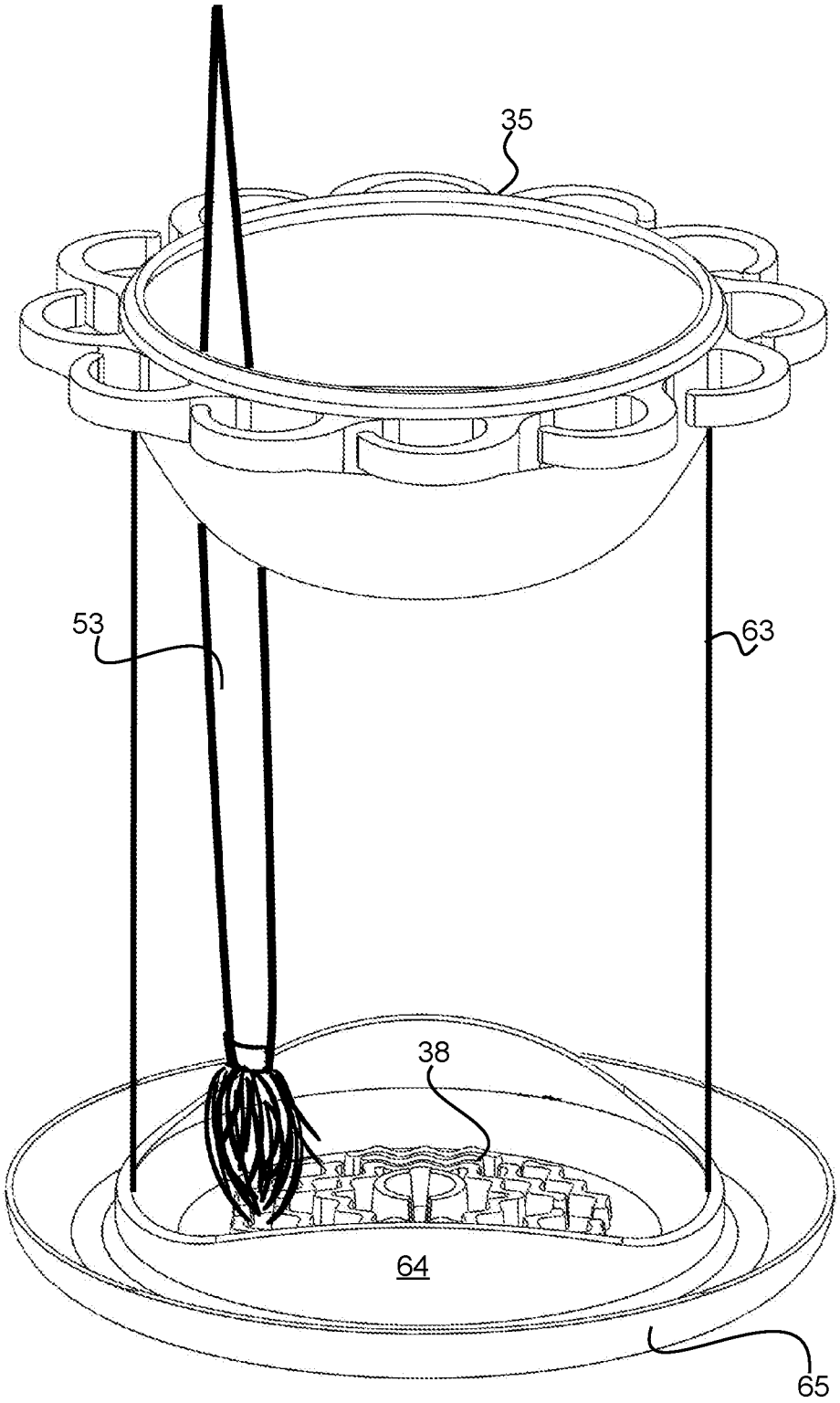
FIG. 14 shows a perspective view of a convertible brush-cleaning system with the topper of FIG. 10, a straight-side cylinder container, a paint puck, a paint brush and a footing.

FIG. 14 shows a perspective view of a convertible brush-cleaning system with the topper 35 of FIG. 10, a straight-sided cylinder container 63, a paint puck 38, a paint brush 53 and a footing 64.

In this embodiment of the invention, the footing includes a plastic or elastomeric drip tray 65 around the rim of the footing. A cup-shaped rim 66 extends around the outside of the drip tray. The drip tray accommodates the paint brushes stored in the brush clips of the topper.

All elastomeric or silicone portions of the system are separable from the more rigid solvent container 63 for easy cleaning. In some embodiments, the drip tray 65 is a separate, separable portion from the footing 64.

Figure 15:
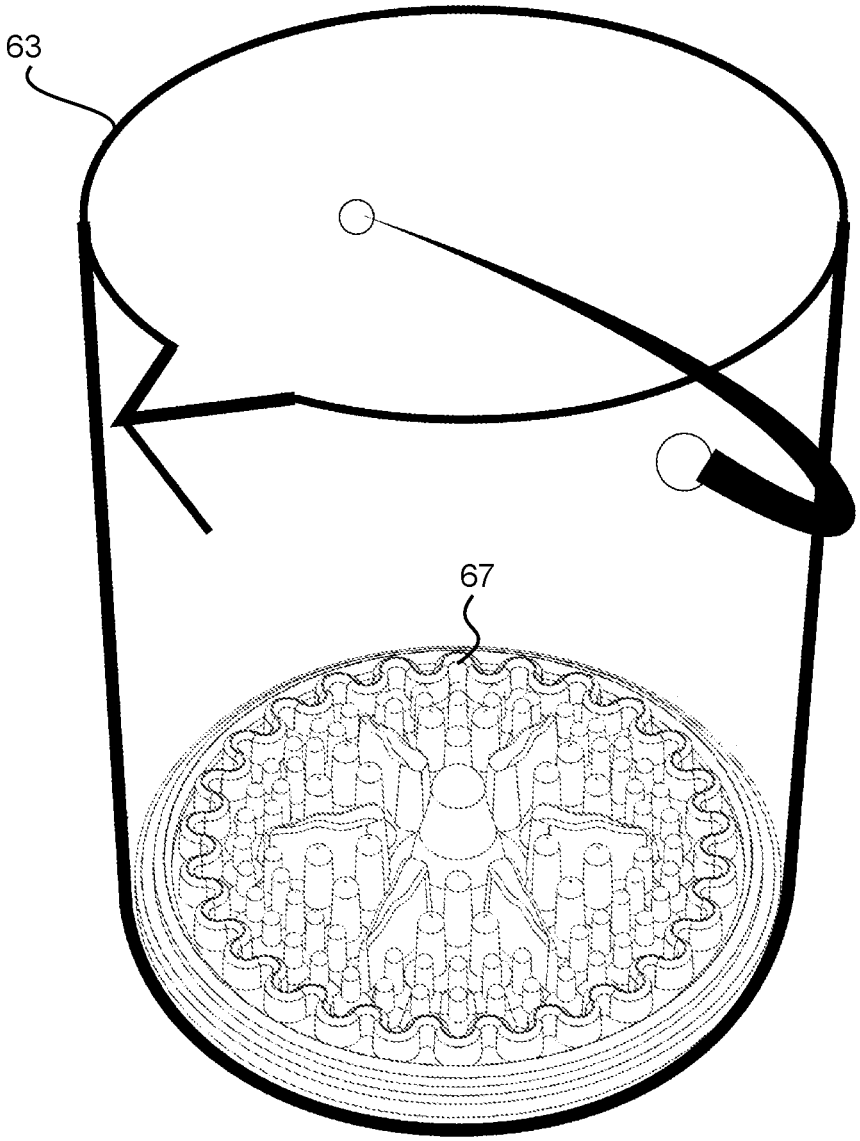
FIG. 15 shows a perspective view of a convertible brush-cleaning system with a large paint bucket and additional paint bucket puck.

FIG. 15 shows a perspective view of a convertible brush-cleaning system with a large paint bucket 66 and additional bucket puck 67. In this embodiment of the invention, a paint bucket puck is proportioned to fit standard size paint buckets, such as a one-gallon paint bucket or a five-gallon paint bucket. The diameter of the paint bucket puck is scaled to be equal to or slight lower than the interior bottom diameter of the matching bucket. Further, since the paint bucket puck is typically used with heavier paints and heavier brushes, the dimensions and hardness of the paint bucket puck are also scaled up.

Thus, for a one-gallon paint bucket, a paint bucket puck has a bucket puck diameter of at least 140 mm and no more than 170 mm, and has a Shore(A) hardness of at least 45. For a five-gallon paint bucket, also known as an 18 liter bucket or a 20 liter bucket, a paint bucket puck has a bucket puck diameter of 200 mm to 320 mm and a Shore(A) hardness of at least 55.

In some embodiments of the brush cleaning system, a bucket container having a bucket-style handle is provided matched to the paint bucket buck. Also, in some embodiments of the invention, the paint bucket has raised, figured or corrugated bottom interior surface portions, to which the bottom surface of the paint bucket puck is molded. Finally, some embodiments of the paint bucket puck include an attached flexible grip tab that is extensible above the height of the paint bucket such that the paint bucket puck may be removed without reaching into the bottom of the bucket.

Although the present invention has been described in connection with certain specific embodiments for instructional purposes, the present invention is not limited thereto. Accordingly, various modifications, adaptations, and combinations of various features of the described embodiments can be practiced without departing from the scope of the invention.

What is claimed is:

1. An apparatus for cleaning paint brushes, comprising:

a solvent container topper, the solvent container topper comprising:

an upper rim having a diameter, an upper surface and a lower surface;

a brush-cleaning vertical rim extending upward from the upper rim of the solvent container topper;

a brush holder portion extending outward horizontally from said upper rim; and, a gripping lip extending downward from the lower surface of the upper rim, said gripping lip having a rest interior diameter and a lip rim, wherein the transverse cross-sectional area of said lip rim is non-circular; and, wherein the lip rim of said gripping lip describes a sinusoidal path comprising at least a bottom half of a sine wave.

2. The apparatus of claim 1, further comprising:

a solvent container having an upper opening and a base, said solvent container upper opening having an exterior diameter and said solvent container base having an exterior diameter and an interior diameter;

said container topper gripping lip rest interior diameter being sized to fit snugly over the exterior diameter of said solvent container upper opening exterior diameter; and, the apparatus also comprising at least one of:

a basic paint puck having a paint puck diameter, said paint puck diameter being at least 90% but less than 100% the solvent container base interior diameter;

a turpenoid-expansible paint puck portion of the convertible brush-cleaning system capable of expanding in turpenoid solvent, said turpenoid-expansible paint puck having a rest diameter and an expanded diameter; and, a bucket puck having a bucket puck diameter.

3. An apparatus for cleaning paint brushes, comprising:

a solvent container topper, the solvent container topper comprising:

an upper rim having a diameter, an upper surface and a lower surface;

a brush holder portion extending outward horizontally from said upper rim; and, a gripping lip of elastomeric material extending downward from the lower surface of the upper rim, said gripping lip having a rest interior diameter, a radial stretch capacity, a maximum-stretch interior diameter and a lip rim, the maximum-stretch interior diameter of the gripping lip being greater than the diameter of the upper rim such that the gripping lip is fittable around a container opening where the container opening is greater in diameter than the diameter of the upper rim of the solvent container topper.

4. The apparatus of claim 3, wherein the transverse cross-sectional area of said lip rim is non-circular.

5. The apparatus of claim 3, wherein the transverse cross-sectional area of said lip rim is non-circular; and, wherein the lip rim of said gripping lip describes a sinusoidal path comprising at least a bottom half of a sine wave.

6. The apparatus of claim 3, further comprising:

a container footing having an upper surface and a lower surface, said container footing being heavier than the solvent container topper, said container footing being separable from the solvent container topper, the container footing comprising:

an upper lip extending from the upper surface of the container footing, said container footing upper lip having a container footing upper lip diameter;

a flat heel portion extending from the lower surface of the container footing, said heel portion being composed of elastomeric material, said heel portion being equal to or greater in diameter than the container footing upper lip diameter;

said flat heal portion having an outer rim; and, a drip tray extending horizontally from the outer rim of the flat heel portion, said drip tray having a cup-shaped rim.

7. An apparatus for cleaning paint brushes, comprising:

a solvent container topper, the solvent container topper comprising:

an upper rim having a diameter, an upper surface and a lower surface;

a brush holder portion extending outward horizontally from said upper rim;

a gripping lip of elastomeric material extending downward from the lower surface of the upper rim, said gripping lip having a rest interior diameter, a radial stretch capacity, a maximum-stretch interior diameter and a lip rim; and, a downward-sloping squeegeeing shelf extending inward from the upper rim of the container topper.

8. The apparatus of claim 7, the squeegeeing shelf comprising a first squeegeeing channel that terminates in a brush-holder squeegee slot of a first size.

9. The apparatus of claim 7, the squeegeeing shelf comprising:

a first squeegeeing channel that terminates in a first brush-holder squeegee slot of a first size, and a second squeegeeing channel that terminates in a second brush-holder squeegee slot of a second size larger than said first brush-holder squeegee slot.

10. The apparatus of claim 7, wherein the brush holder portion comprises paint-brush holding holes.

11. The apparatus of claim 7, wherein the brush holder portion comprises paint-brush holding clips.

12. The apparatus of claim 7, wherein the transverse cross-sectional area of said lip rim is non-circular.

13. The apparatus of claim 7, wherein the transverse cross-sectional area of said lip rim is non-circular and wherein the lip rim of said gripping lip describes a sinusoidal path comprising at least a bottom half of a sine wave.

14. The apparatus of claim 7, wherein the transverse cross-sectional area of said lip rim is non-circular and wherein the squeegeeing shelf comprises a first squeegeeing channel that terminates in a brush-holder squeegee slot of a first size.

15. The apparatus of claim 7 wherein the transverse cross-sectional area of said lip rim is non-circular;

wherein the squeegeeing shelf comprises a first squeegeeing channel that terminates in a brush-holder squeegee slot of a first size; and wherein the maximum-stretch interior diameter of the gripping lip is greater than the diameter of the upper rim such that the gripping lip is fittable around a container opening when the container opening is greater in diameter than the diameter of the upper rim of the solvent container topper.

16. The apparatus of claim 7, wherein the transverse cross-sectional area of said lip rim is non-circular;

wherein the lip rim of said gripping lip describes a sinusoidal path comprising at least a bottom half of a sine wave;

wherein the squeegeeing shelf comprises a first squeegeeing channel that terminates in a brush-holder squeegee slot of a first size; and wherein the maximum-stretch interior diameter of the gripping lip is greater than the diameter of the upper rim such that the gripping lip is fittable around a container opening when the container opening is greater in diameter than the diameter of the upper rim of the solvent container topper.

17. The apparatus of claim 7, wherein the transverse cross-sectional area of said lip rim is non-circular;

wherein the lip rim of said gripping lip describes a sinusoidal path comprising at least a bottom half of a sine wave;

wherein the squeegeeing shelf comprises a first squeegeeing channel that terminates in a first brush-holder squeegee slot of a first size and a second squeegeeing channel that terminates in a second brush-holder squeegee slot of a second size larger than said first brush-holder squeegee slot; and wherein the maximum-stretch interior diameter of the gripping lip is greater than the diameter of the upper rim such that the gripping lip is fittable around a container opening when the container opening is greater in diameter than the diameter of the upper rim of the solvent container topper.

18. The apparatus of claim 7, wherein the transverse cross-sectional area of said lip rim is non-circular;

wherein the lip rim of said gripping lip describes a sinusoidal path comprising at least a bottom half of a sine wave;

wherein the squeegeeing shelf comprises a first squeegeeing channel that terminates in a first brush-holder squeegee slot of a first size and a second squeegeeing channel that terminates in a second brush-holder squeegee slot of a second size larger than said first brush-holder squeegee slot;

wherein the maximum-stretch interior diameter of the gripping lip is greater than the diameter of the upper rim such that the gripping lip is fittable around a container opening when the container opening is greater in diameter than the diameter of the upper rim of the solvent container topper; and, wherein the apparatus further comprises a container footing having an upper surface and a lower surface, said container footing being heavier than the solvent container topper, said container footing being separable from the solvent container topper, the container footing comprising:

an upper lip extending from the upper surface of the container footing, said container footing upper lip having a container footing upper lip diameter; and a flat heel portion extending from the lower surface of the container footing, said heel portion being composed of elastomeric material, said heel portion being equal to or greater in diameter than the container footing upper lip diameter.

19. The apparatus of claim 7, wherein the transverse cross-sectional area of said lip rim is non-circular;

wherein the lip rim of said gripping lip describes a sinusoidal path comprising at least a bottom half of a sine wave;

wherein the squeegeeing shelf comprises a first squeegeeing channel that terminates in a first brush-holder squeegee slot of a first size and a second squeegeeing channel that terminates in a second brush-holder squeegee slot of a second size larger than said first brush-holder squeegee slot;

wherein the maximum-stretch interior diameter of the gripping lip is greater than the diameter of the upper rim such that the gripping lip is fittable around a container opening when the container opening is greater in diameter than the diameter of the upper rim of the solvent container topper; and, wherein the apparatus further comprises a container footing having an upper surface and a lower surface, said container footing being heavier than the solvent container topper, said container footing being separable from the solvent container topper, the container footing comprising:

an upper lip extending from the upper surface of the container footing, said container footing upper lip having a container footing upper lip diameter; and a flat heel portion extending from the lower surface of the container footing, said heel portion being composed of elastomeric material, said heel portion being equal to or greater in diameter than the container footing upper lip diameter; said flat heal portion having an outer rim; and, a drip tray extending horizontally from the outer rim of the flat heel portion, said drip tray having a cup-shaped rim.

20. The apparatus of claim 7, further comprising:

a solvent container having an upper opening and a lower opening, said solvent container upper opening having an exterior diameter and said solvent container lower opening having an exterior diameter;

a container footing having an upper surface and a lower surface, said container footing being separable from the solvent container, the container footing comprising:

an upper surface;

an upper lip extending from the upper surface of the container footing, said container footing upper lip having an inner rim and a container footing upper lip diameter;

a paint puck that is of one body with the upper surface of the container footing, the paint puck having an outer rim, there also being a circular slot between the outer rim of the paint puck and the inner rim of the upper lip, said circular slot being of such size as to admit the solvent container lower opening.

* * * * *